US007886475B2

(12) United States Patent
Dubois

(10) Patent No.: US 7,886,475 B2
(45) Date of Patent: Feb. 15, 2011

(54) FIREARM SIGHT

(75) Inventor: Jason R. Dubois, North Smithfield, RI (US)

(73) Assignee: Smith & Wesson Corp., Springfield, MA (US)

( * ) Notice: Subject to any disclaimer, the term of this patent is extended or adjusted under 35 U.S.C. 154(b) by 328 days.

(21) Appl. No.: 11/971,987

(22) Filed: Jan. 10, 2008

(65) Prior Publication Data

US 2010/0281750 A1 Nov. 11, 2010

Related U.S. Application Data

(60) Provisional application No. 60/884,276, filed on Jan. 10, 2007.

(51) Int. Cl.
*F41G 1/00* (2006.01)

(52) U.S. Cl. ..... 42/113; 42/111; 42/138

(58) Field of Classification Search ..... 42/111, 42/113, 137, 148, 140, 136, 138
See application file for complete search history.

(56) References Cited

U.S. PATENT DOCUMENTS 507,278 A * 10/1893 Latta ..... 42/137
875,016 A * 12/1907 Uren et al. ..... 42/148
958,951 A * 5/1910 Wollenberg ..... 42/137
1,206,310 A * 11/1916 Debuchy ..... 42/148
1,485,064 A * 2/1924 Berger ..... 42/138
2,127,565 A * 8/1938 King et al. ..... 42/137
2,334,300 A * 11/1943 Williams ..... 42/140
3,279,072 A * 10/1966 Choate et al. ..... 42/136
4,607,445 A * 8/1986 Choate ..... 42/137
7,296,376 B2 * 11/2007 Kidd ..... 42/136
2003/0074824 A1 * 4/2003 Arachequesne ..... 42/111

* cited by examiner

*Primary Examiner*—Michelle Clement
(74) *Attorney, Agent, or Firm*—McCormick, Paulding & Huber LLP

(57) ABSTRACT

A sight for a firearm including a body having an upper portion and a lower portion, the lower portion having opposing sidewalls. Each of the sidewalls including at least one protrusion. The protrusions abuttingly engage sidewalls of a barrel receptacle to secure the sight to the firearm. Additionally, the protrusions facilitate insertion of the sight in the receptacle without the need to machine or grind the lower portion prior to insertion.

11 Claims, 5 Drawing Sheets

FIREARM SIGHT

CROSS REFERENCE TO RELATED APPLICATIONS

This application claims the benefit of U.S. Provisional Application Ser. No. 60/884,276, filed on Jan. 10, 2007, hereby incorporated by reference in its entirety.

FIELD OF THE INVENTION

The present invention relates generally to a sight for a firearm. The present invention relates more specifically to a pinned front sight for a revolver that has raised contact surfaces, which eliminate the need for machining the sight prior to installation.

BACKGROUND OF THE INVENTION

Pinned front sights on firearms such as revolvers are typically forced into mating engagement with a receptacle on the upper surface of the barrel and are then pinned in place. To ensure a proper fit between the sight and receptacle, sights must be ground or milled to relatively high tolerances. Moreover, variations in the dimensions of barrel receptacles between firearm models typically necessitate high tolerance machining of individual sights prior to installation.

In view of the above, there exists a need for a front sight that may be machined to lower tolerances and may be mounted on multiple firearm models with barrel sight receptacles of varying dimensions. The present invention fulfills these needs and more.

SUMMARY OF THE INVENTION

It is an object of the present invention to provide a front sight for a firearm that can fit multiple firearm models.

It is an additional object of the present invention to provide a front sight for a firearm that may be manufactured at lower tolerances.

It is another object of the present invention to provide a front sight for a firearm that may be manufactured at lower tolerances so as to not require precision machining prior to installation on a firearm.

It is an additional object of the present invention to provide a front sight for a firearm that has an engagement portion with a plurality of raised contact surfaces.

It is an object of the present invention to provide a front sight for a firearm with an engagement portion with at least four raised contact surfaces that may be press fit into a barrel receptacle.

It is a further object of the present invention to provide a front sight for a firearm with an engagement portion that may be press fit into a barrel receptacle and then pinned in place.

It is an additional object of the present invention to provide a front sight for a revolver that has an engagement portion with at least four contact surfaces that may be press fit into a barrel receptacle so that the sight may be manufactured at a lower tolerance and may mounted to a variety of revolver models An embodiment of the present invention is a sight for a firearm including a body having an upper portion and a lower portion, the lower portion having opposing sidewalls, each of which include at least one protrusion. The protrusions abuttingly engage sidewalls of a barrel receptacle to secure the sight to the firearm. Additionally, the protrusions facilitate insertion of the sight in the receptacle without the need to machine or grind the lower portion prior to insertion.

These and other objects of the present invention, and their preferred embodiments, shall become clear by consideration of the specification and drawings taken as a whole.

DETAILED DESCRIPTION OF THE PREFERRED EMBODIMENT

Figure 1:
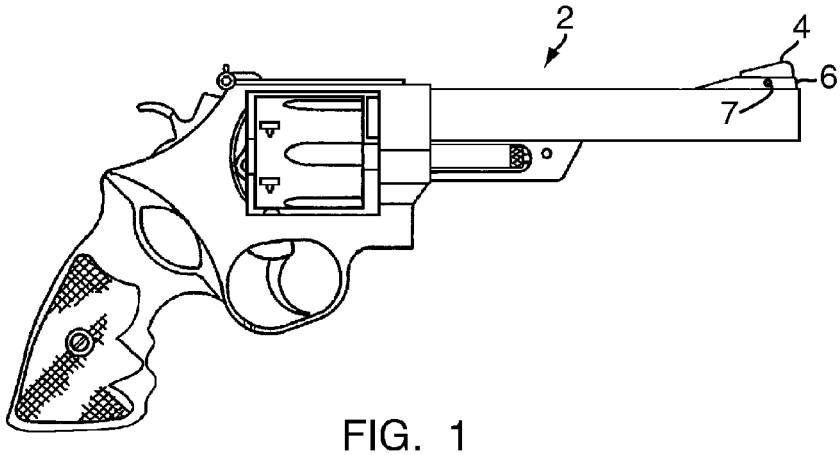
FIG. 1 Prior Art
FIG. 1 is a side view of a prior art revolver depicting a pinned front sight.

FIG. 1 depicts a known revolver 2 with a pinned front sight 4. The front sight 4 is fitted into a slot or receptacle 6 on the upper surface of the revolver barrel. Typically, the receptacle 6 is a substantially u-shaped channel with sidewalls that extend longitudinally along a front portion of the barrel. Each receptacle sidewall has an aperture 7 extending through the wall so that a pin may be placed through both the receptacle 6 and sight 4, securing the sight in place.

Figure 2:
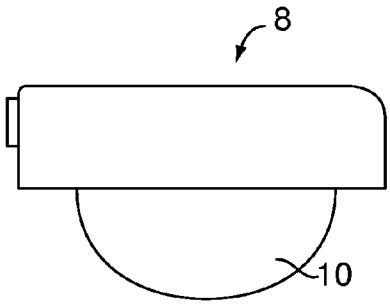
FIG. 2 Prior Art
FIG. 2 is a side view of a prior art front sight.
Figure 3:
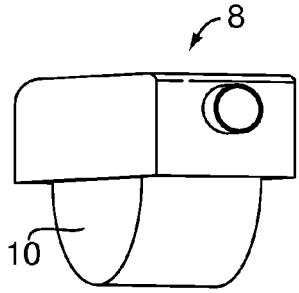
FIG. 3 Prior Art
FIG. 3 is a front view of the prior art front sight of FIG. 2.

Referring now to FIGS. 2-3, a known front sight 8 is depicted. The front sight 8 has an engagement portion 10 on its bottom surface. During assembly, the engagement portion 10 the front sight 8 is pressed or slid into the barrel receptacle 6 (FIG. 1) and a pin is then placed through the apertures 7 in the receptacle 6 and through an aperture in the engagement portion 10 of the sight 8 (not shown).

As will be appreciated, the engagement portion 10 of the front sight 8 must be manufactured to a relatively high tolerance to securely fit into the barrel receptacle 6 prior to being pinned. Moreover, variations in the dimensions of barrel receptacles between firearm models necessitate separate pinned front sights per model. Additionally, the engagement portion 10 must often be precision machined or ground, post-manufacture, prior to installation to closely fit the dimensions of the receptacle 6 to ensure a proper press-fit. This process is laborious and relatively expensive. As described in greater detail below, the present invention addresses these issues and provides a solution that is currently unknown in the art.

Figure 4:
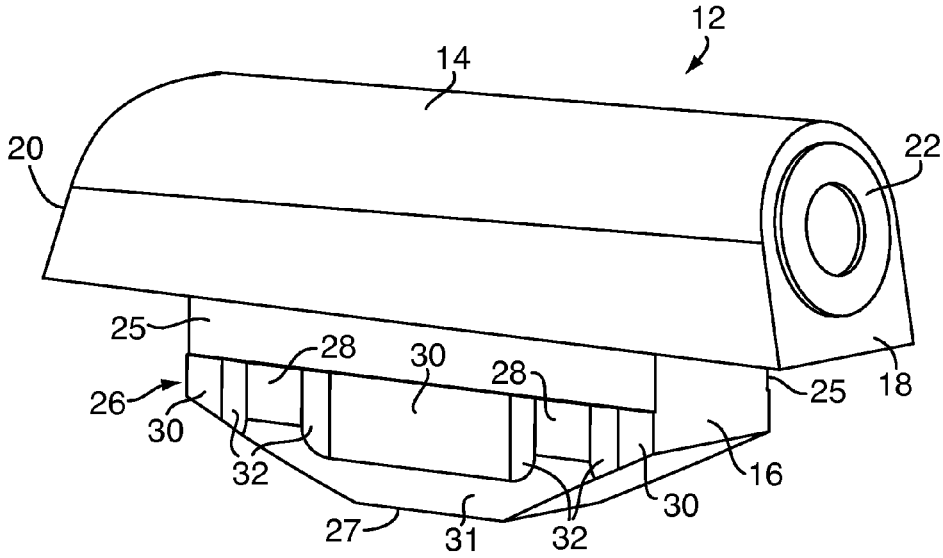
FIG. 4 is a perspective view of a firearm sight in accordance with an embodiment of the present invention.
Figure 5:
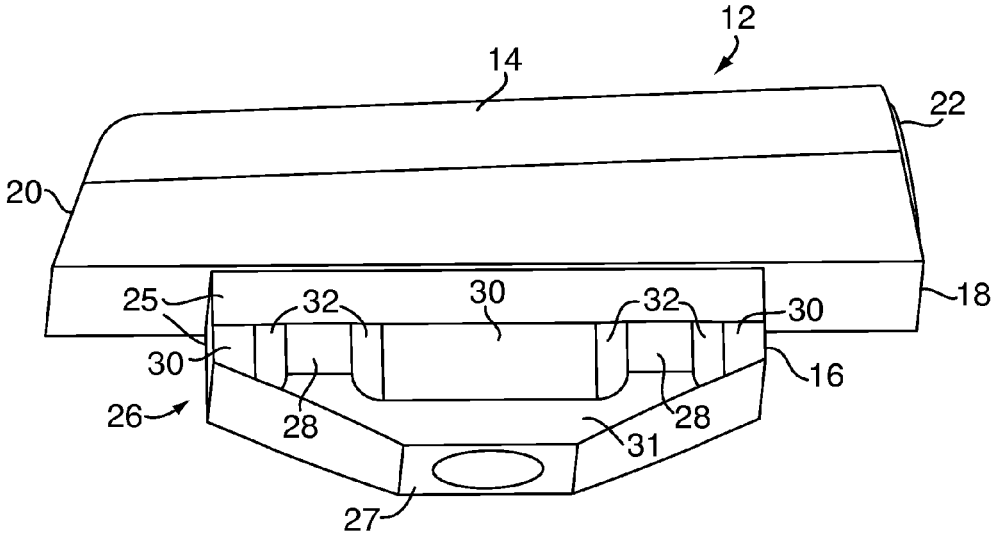
FIG. 5 is a bottom perspective view of the firearm sight of FIG. 4.
Figure 6:
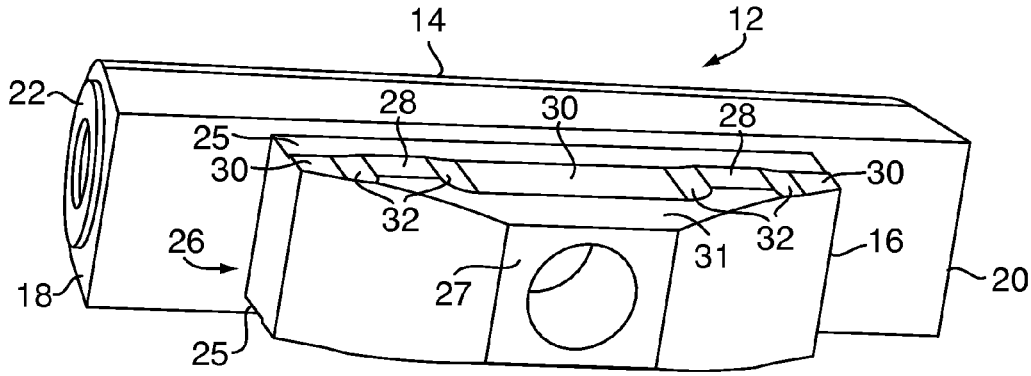
FIG. 6 is another bottom perspective view of the firearm sight of FIG. 4 illustrating outwardly extending ribs.

Referring now to FIG. 4, a preferred embodiment of the inventive sight 12 is depicted. The sight 12 includes generally an upper portion 14 and a lower portion 16. The upper portion 14 has a rear end 18 and a front end 20, the front end 20 being proximal to the distal end of a firearm barrel when assembled. The upper portion 14 protrudes upward from the barrel receptacle 34 (FIG. 9) when assembled and the lower portion extends into the receptacle 34 to secure the sight to the firearm. While the lower portion 16 is depicted with a substantially U-shaped side profile, it will be readily apparent that other profiles may be employed provided the lower portion 16 can extend into the barrel receptacle 34 to an extent that allows the sight to be properly mounted and secured to the firearm barrel.

As depicted, the upper portion 14 includes a locating indicator 22, such as a dot or bead. The indicator 22, in combination with a rear sight (not shown), allows the firearm to be effectively aimed and accurately discharged. As will be appreciated, various indicators may be employed and the indicator may include a luminescent material for use in environments with reduced or low light.

Figure 9:
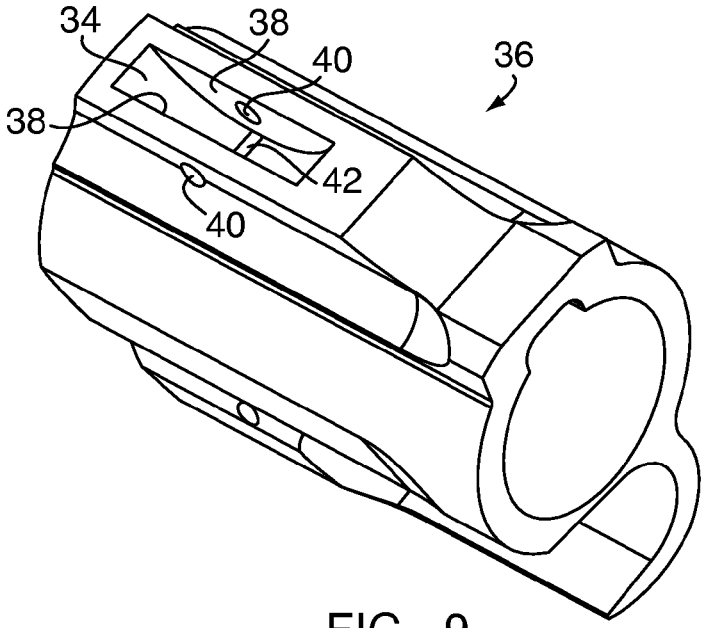
FIG. 9 is a sectioned perspective view of a barrel with a sight receptacle for use with the firearm sight of FIG. 4.

Turning to FIGS. 5-8, the lower portion 16 of the sight 12 is generally rectangular and extends into a receptacle 34 machined into the firearm barrel (FIG. 9). The lower portion 16 includes longitudinally extending opposing side surfaces 25 which are substantially co-planar and perpendicular to one another. The side surfaces 25 include an engagement portion 26, which includes a plurality of contact surfaces or ribs 28. In the embodiment depicted, there are two ribs 26 per side surface 25.

The ribs 28 extend transversely along the engagement portion 26. The ribs 28 are separated by flats portions 30. The ribs 28 also have a radiused or scalloped portion 32 that is adjacent both the ribs 28 and the flats portions 30. The ribs 28 extend outward from the planar side surfaces 25 and contact interior surfaces of the receptacle 34 (FIG. 9).

As will be apparent, the ribs 28 are a critical aspect of the present invention as they allow the inventive sight 12 to be inserted into a barrel sight receptacle without pre-insertion machining or grinding. More specifically, the reduced surface area of the engagement portion 26 created by the ribs 28 allows for the deformation of the ribs 28 and/or interior walls of the receptacle, so that the sight 12 may be received within receptacles of varying dimensions with the removal of material from the engagement portion prior to insertion. More specifically, the ribs 28 reduce surface area interference between the sight 12 and the barrel receptacle creating a greater width tolerance. This, in turn, provides an ease of manufacture and assembly not presently available in the art and allows a single sight with multiple firearm models.

The sight 12 preferably has at least four ribs 28. The four ribs 12 allow the sight 12 to be utilized where the fit between the sight 12 and the walls of a barrel receptacle is relatively loose. The ribs 28 allow the sight to be aligned properly in the receptacle so that it may be pinned in place. While four ribs is the preferred configuration, it may be possible to have greater or fewer ribs, as long as they allow the sight to be inserted and aligned in the barrel receptacle without machining or grinding.

The inventive sight 12 is preferably manufactured from a metal that may be slightly deformed but is suitably strong for use as with a firearm. Moreover, the size and configuration of the ribs 28 on the engagement portion of the sight may vary provided they assist in the seating of the front sight into its barrel receptacle and allow for some deformation as described above.

Figure 7:
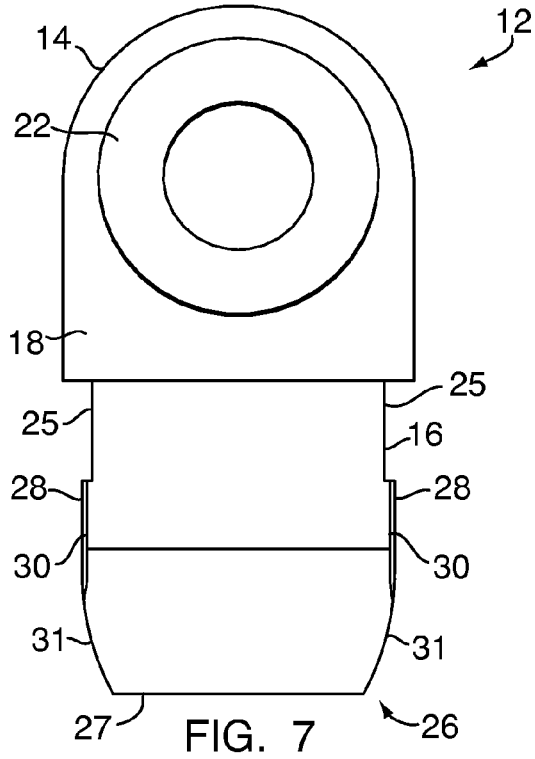
FIG. 7 is an end view of a rear end of the firearm sight of FIG. 4.
Figure 8:
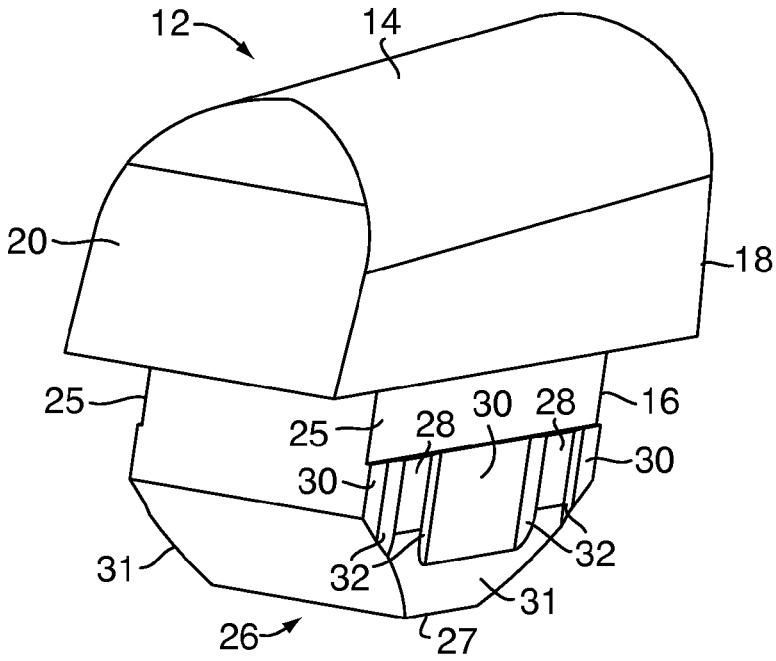
FIG. 8 is a perspective view of a front end of the firearm sight of FIG. 4.

The sight 12 also has a bottom surface 27 as depicted in FIG. 7. The bottom surface 27 has a reduced width. Moreover, the engagement portion 26 of the side surfaces 25 includes curved or tapering sides 31. As will be appreciated, the curved sides 31 facilitate the insertion of the sight 12 in firearm barrel receptacles.

Turning now to FIG. 9, the inventive sight 12 is mounted in a receptacle 34 that is machined into or formed on a firearm barrel 36. The receptacle 34 is substantially rectangular and includes opposing sidewalls 38 and well as a bottom surface 42. The sidewalls 38 include a bore or aperture 40, which is configured to receive a pin (not shown). When assembled, the ribs 28 abuttingly contact the sidewalls 38 of the receptacle 34 thereby, along with the pin, securing the sight 12 within the receptacle 34. While the shape of bottom surface 42 is depicted as curved, as will be appreciated, various shapes may be utilized provided they accommodate the engagement portion 26 of the sight 12.

Figure 10:
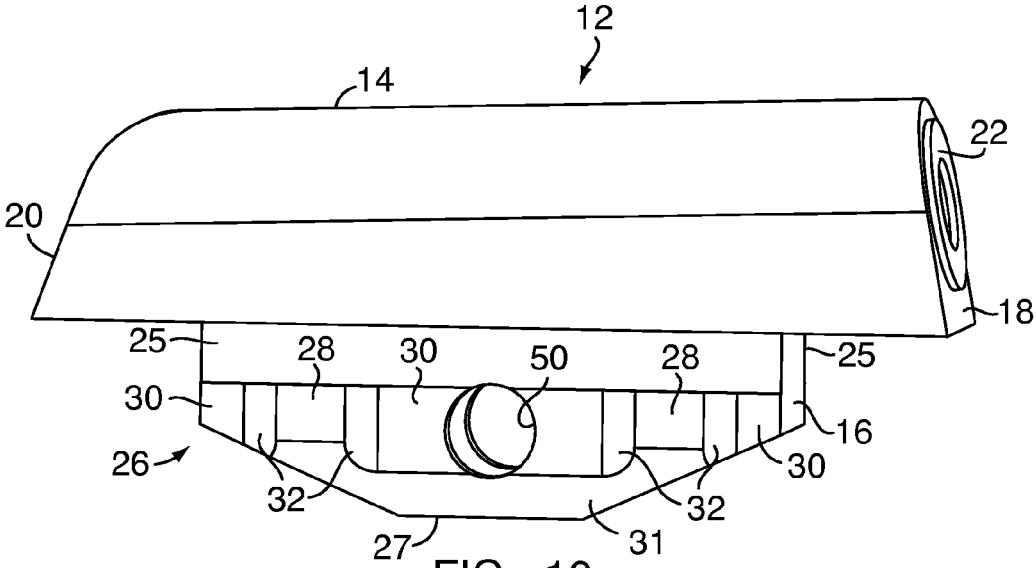
FIG. 10 is a perspective side view of the firearm sight of FIG. 4 illustrating an aperture configured to receive a pin.
Figure 11:
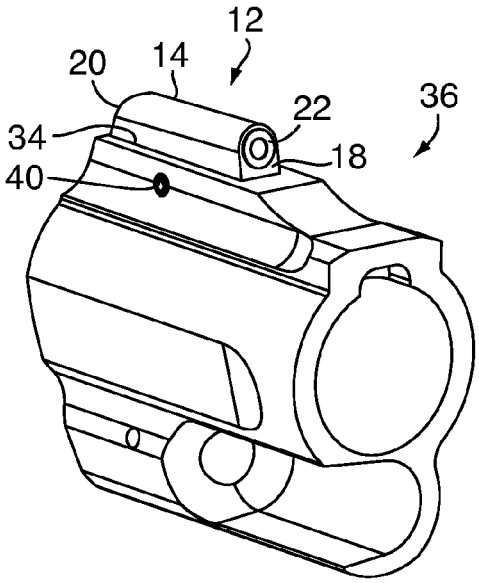
FIG. 11 is a perspective side view of the firearm sight of FIG. 4 inserted into the sight receptacle of FIG. 9.

Referring to FIGS. 9-11, in use, the sight 12 is inserted and pressed into the receptacle 34. As the sight is urged in, the ribs of the engagement portion 26 slidably engage the sidewalls of the receptacle and slightly deforming the walls and/or ribs until the lower portion 16 of the sight is fully contained within the receptacle 34. The interengagement of ribs 28 and receptacle sidewalls 38 forms a relatively tight and secure press or form fit.

In addition to the engagement of the ribs 28 and sidewalls 38, the sight 12 is pinned in place in the receptacle. More specifically, the sight is inserted into the receptacle and, using the sidewall aperture 40 as a guide, a bore 50 is drilled through the sight 12. A pin (not shown) is then inserted through both the sidewall aperture 40 and the aligned sight bore 50 thereby securing the sight to the firearm barrel.

As shown, the sight is shaped such that the bore 50 is formed in the central flat portion 30 located between the ribs 28. This surface is substantially planar and provides an ideal surface for the bore 50.

In sum, the inventive sight employs a plurality of raised ribs, which engage sidewalls of a barrel receptacle allowing the ribs/sidewalls to slightly deform upon insertion of the sight. This, in turn, allows a single sight to be used with multiple firearm models, with sight receptacles of varying dimensions, and eliminates the need to precisely machine or grind a sight prior to insertion.

While preferred embodiments of the invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A sight for a firearm, said sight comprising:

a body having an upper portion and a lower portion, said upper portion having a locating indicator and said lower portion having opposing sidewalls;

at least two ribs extending transversely along each of said sidewalls, said ribs spaced apart by a flats portion; and wherein said ribs abuttingly engage interior walls of a firearm barrel receptacle to secure said sight to said firearm and said ribs facilitate insertion of said sight in said receptacle without the need to machine or grind said lower portion of said sight prior to insertion.

2. The sight of claim 1 wherein said lower portion is tapered.

3. The sight of claim 1 wherein said locating indicator is a dot.

4. A front sight for a firearm, said sight comprising:

a body having an upper portion and a lower portion, said upper portion having a locating indicator and said lower portion having opposing sidewalls;

at least two ribs extending transversely along each of said sidewalls, said ribs spaced apart by a flats portion having a bore extending through said sight, said bore being capable of receiving a pin to secure said sight to said firearm; and wherein said ribs abuttingly engage interior walls of a firearm barrel receptacle to secure said sight to said firearm and said ribs facilitate insertion of said sight in said receptacle without the need to machine or grind said lower portion of said sight prior to insertion.

5. The front sight of claim 4 wherein said lower portion is tapered.

6. The front sight of claim 4 wherein said locating indicator is a dot.

7. The firearm of claim 4 wherein said ribs spaced apart by a flats portion, said flats portion having a bore extending through said sight, said bore being capable of receiving a pin to secure said sight to said firearm.

8. A method securing a sight to a firearm comprising the steps of:

forming a sight having upper and lower portions, said lower portion including opposing sidewalls, each sidewall having at least two ribs extending transversely along said sidewall, said ribs spaced apart by a flats portion;

inserting said sight into a sight receptacle formed in a barrel of a firearm such that said ribs engage walls of said receptacle; and securing said sight in said receptacle by inserting a pin through said sight and said receptacle.

9. The method of claim 8 wherein said upper portion of said sight includes a locating indicator.

10. The method of claim 8 wherein said lower portion of said sight is tapered.

11. The method of claim 8 wherein said visual indicator is a dot.

* * * * *